US010004940B2

(12) United States Patent
Badarneh

(10) Patent No.: US 10,004,940 B2
(45) Date of Patent: Jun. 26, 2018

(54) EXERCISING BICYCLE

(71) Applicant: Activetainment AS, Oslo (NO)

(72) Inventor: Ziad Badarneh, Oslo (NO)

(73) Assignee: Activetainment AS, Oslo (NO)

( * ) Notice: Subject to any disclaimer, the term of this patent is extended or adjusted under 35 U.S.C. 154(b) by 266 days.

(21) Appl. No.: 14/648,771

(22) PCT Filed: Dec. 2, 2013

(86) PCT No.: PCT/NO2013/050210

§ 371 (c)(1),
(2) Date: Jun. 1, 2015

(87) PCT Pub. No.: WO2014/084742

PCT Pub. Date: Jun. 5, 2014

(65) Prior Publication Data

US 2015/0290490 A1 Oct. 15, 2015

(30) Foreign Application Priority Data

Nov. 30, 2012 (NO) ..... 20121437
Feb. 8, 2013 (NO) ..... 20130220

(51) Int. Cl.
*A63B 22/00* (2006.01)
*A63B 21/005* (2006.01)
(Continued)

(52) U.S. Cl.
CPC ..... *A63B 22/0015* (2013.01); *A63B 21/0051* (2013.01); *A63B 21/0053* (2013.01);
(Continued)

(58) Field of Classification Search
CPC ..... A63B 22/0015; A63B 21/0053; A63B 21/0051; A63B 21/0076; A63B 21/0058;
(Continued)

(56) References Cited

U.S. PATENT DOCUMENTS 4,743,012 A 5/1988 Kim
4,887,967 A * 12/1989 Letovsky ..... G09B 9/058 434/61

(Continued)

FOREIGN PATENT DOCUMENTS

WO 2005/046806 A2 5/2005
WO 2007/055584 A1 5/2007

OTHER PUBLICATIONS

International Search Report in International Application No. PCT/NO2013/050210 dated May 8, 2014.

(Continued)

*Primary Examiner* — Sundhara Ganesan
(74) *Attorney, Agent, or Firm* — Oppedahl Patent Law Firm LLC

(57) ABSTRACT

A training bicycle, including a first frame (1, 36) configured to be supported on a floor, a second frame (2, 37) connected to the first frame, the second frame including an axle (4) allowing the second frame to tilt relative to the first frame along an axis in the longitudinal direction of the training apparatus, a handlebar (12, 35, 77, 90) connected to the upper end of a steering shaft (11, 76), the steering shaft being rotationally connected to the second frame, a crank (26, 110) connected to the second frame, and a first flywheel (22, 41, 56, 167, 193) rotationally connected to the lower end of said steering shaft with means for transferring movement from the crank to the first flywheel.

24 Claims, 13 Drawing Sheets

(51) Int. Cl.
*A63B 21/00* (2006.01)
*A63B 22/06* (2006.01)
*A63B 24/00* (2006.01)
*A63B 71/06* (2006.01)

(52) U.S. Cl.
CPC .... *A63B 21/0058* (2013.01); *A63B 21/00076* (2013.01); *A63B 21/00192* (2013.01); *A63B 22/0023* (2013.01); *A63B 22/0605* (2013.01); *A63B 24/0075* (2013.01); *A63B 24/0087* (2013.01); *A63B 2022/0017* (2013.01); *A63B 2022/0025* (2013.01); *A63B 2022/0028* (2013.01); *A63B 2022/0611* (2013.01); *A63B 2022/0641* (2013.01); *A63B 2071/0638* (2013.01); *A63B 2071/0647* (2013.01); *A63B 2220/00* (2013.01); *A63B 2220/17* (2013.01); *A63B 2220/20* (2013.01); *A63B 2220/80* (2013.01); *A63B 2220/833* (2013.01); *A63B 2225/09* (2013.01)

(58) Field of Classification Search
CPC ..... A63B 24/0075; A63B 21/00192; A63B 24/0087; A63B 22/0605; A63B 22/023; A63B 2022/0017; A63B 2022/0611; A63B 2022/0028; A63B 2022/0025; A63B 2220/17; A63B 2220/00; A63B 2225/09; A63B 2220/80; A63B 2220/20; A63B 2220/833; A63B 2071/0647; A63B 2071/0638; A63B 2022/0641
See application file for complete search history.

(56) References Cited

U.S. PATENT DOCUMENTS 4,957,282 A * 9/1990 Wakefield ..... A63B 26/003 472/21
5,240,417 A * 8/1993 Smithson ..... A63B 21/00181 348/121
5,890,995 A 4/1999 Bobick
6,126,577 A * 10/2000 Chang ..... A63B 26/003 434/61
6,561,952 B2 * 5/2003 Wu ..... A63B 24/00 434/61
7,481,746 B2 * 1/2009 Ibarguren ..... A63B 22/0605 482/57
7,809,577 B2 * 10/2010 Miyamaru ..... G09B 19/0038 704/272
7,837,595 B2 * 11/2010 Rice ..... A63B 71/0622 434/61
7,857,732 B2 * 12/2010 Nielson ..... A63B 22/0605 482/57
7,927,258 B2 * 4/2011 Irving ..... A63B 21/015 482/51
8,029,287 B2 * 10/2011 Makuta ..... G09B 9/058 434/61
8,029,415 B2 * 10/2011 Ashby ..... A63B 22/0023 482/49
8,033,830 B2 * 10/2011 Ichimi ..... G09B 9/058 434/29
8,062,183 B2 * 11/2011 Rice ..... A63B 22/02 482/1
8,902,352 B2 * 12/2014 Brodie ..... G02B 7/023 348/360
9,381,395 B2 * 7/2016 Pinzon ..... A63B 22/0605
2007/0072744 A1 * 3/2007 Badarneh ..... A63B 22/0605 482/57
2008/0269025 A1 * 10/2008 Badarneh ..... A63B 26/003 482/57
2010/0125029 A1 5/2010 Nielson
2011/0118086 A1 * 5/2011 Radow ..... A63B 21/00196 482/5
2011/0234175 A1 * 9/2011 Hajee ..... A63B 21/0053 320/164

OTHER PUBLICATIONS

Norwegian Search Report in Norwegian Application No. 20130220 filed Feb. 8, 2013 (dual-language).
International Preliminary Report on Patentability in International Application No. PCT/NO2013/050210 completed Mar. 25, 2015.

* cited by examiner

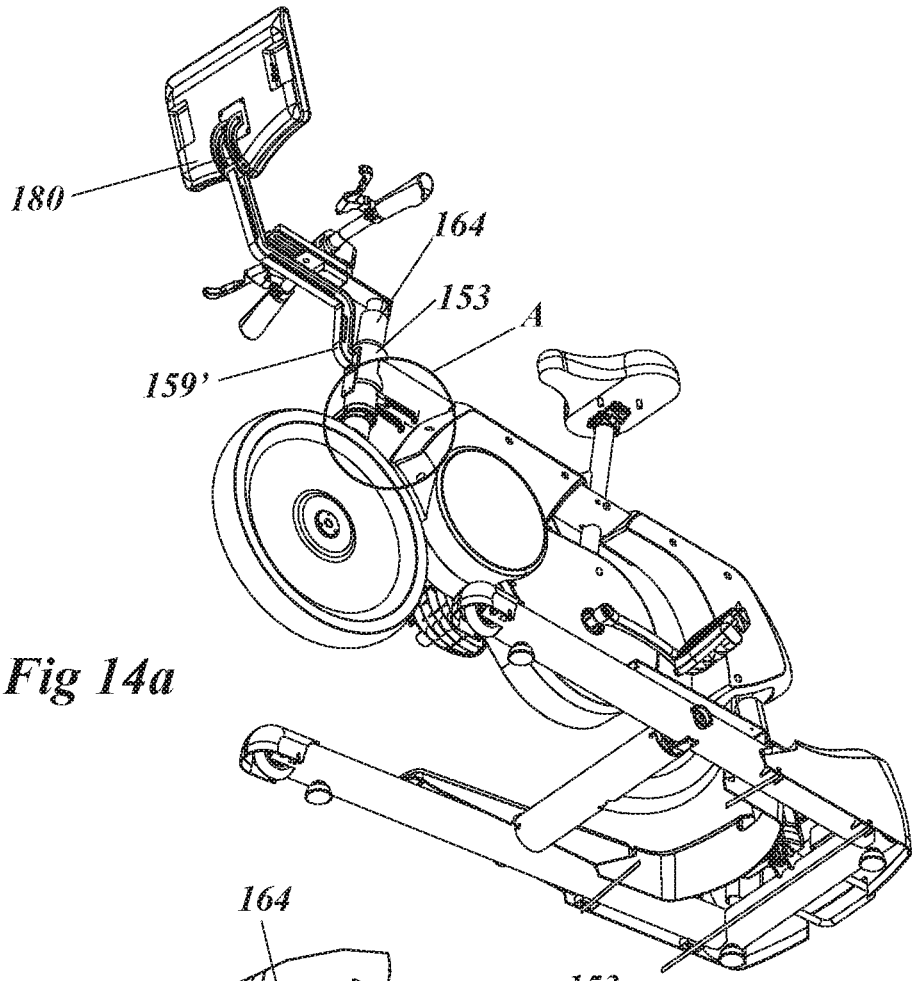
Fig 14a
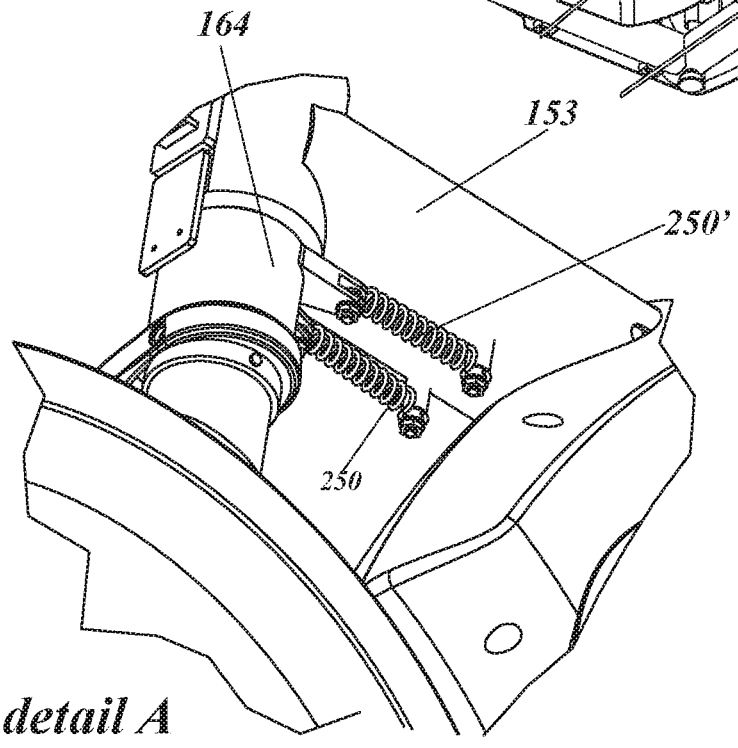
Fig 14b, detail A

EXERCISING BICYCLE

FIELD OF THE INVENTION

The present invention relates to a training apparatus designed as an exercise bicycle.

BACKGROUND

Stationary training bicycles, i.e. ergometer or "spinner" type bicycles, are widely used both in private and in training studios for the physical training of the body.

In training studios several bicycles may be mounted in a group in front of a viewing screen. On the screen is shown a video of a landscape as seen when rolling along a road. The purpose of the screen is to make the exercise less boring. However, the bicycles are still stationary and do not provide any feeling of realism to the users. Such stationary training bicycles will also not provide any training of the balance ability and core muscles as in a real bicycle.

The applicant's earlier patent publications WO2005/046806 and WO2007/055584 disclose an exercise bicycle with a split frame, the upper part tiltable to the sides and with handlebars which turn and control the tilt. Solutions are also shown regarding incline and decline. The purpose of this bicycle is to provide a more realistic ride more like a real bicycle. As the user has to balance his body on the split frame, the user will also receive some training of balance and core muscles.

SUMMARY OF THE INVENTION

An object of the invention is to provide a stationary training apparatus which a user can benefit from physically, but which also can be entertaining and useful, especially when interacting with software programs presented on a screen from a program or an online source. Another object of the invention is to provide a training bicycle which provides an even more realistic experience of the training exercise than prior art training bicycles, and which may help to train additional muscles in the user's body.

This is achieved in a stationary training apparatus as defined in the appended claims.

In particular, the invention relates to a training apparatus for physical exercise, including a first frame configured to be supported on a floor, a second frame connected to the first frame, the second frame including an axle allowing the second frame to tilt relative to the first frame along an axis in the longitudinal direction of the training apparatus, a handlebar connected to the upper end of a steering shaft, the steering shaft being rotationally connected to the second frame, and a crank connected to the second frame. In addition, the apparatus also includes a first flywheel rotationally connected to the lower end of said steering shaft, and means for transferring movement from the crank to the first flywheel.

This means that the flywheel may be turned as on a real bike. When the flywheel spins at high speed, the velocity then produced creates a gyro effect which will resist any turning of the handlebar and which will stabilize the bike, also resisting tilt motion.

From prior art there are known training bicycles that have a tilt motion to the upper frame, with a limited function as the user turning the handlebar can keep in balance, but cannot, if desired turn the handlebar in order to "steer into a curve" interacting with a track shown on a screen, as the present invention.

According to an embodiment of the invention, the transfer means between crank and flywheel includes a belt mechanically transferring rotational movement of the crank to the first flywheel.

According to an alternative embodiment, said transfer means includes a sensor reading the motion of the crank, an electrical motor connected to the first flywheel and means for controlling the speed of the first flywheel according to the speed of the crank.

This solution provides an appreciable simplification of the mechanical design of the apparatus, with improved reliability and less need for maintenance.

According to a third alternative, said transfer means includes a second flywheel, a belt transferring rotational movement from the crank to the second flywheel, an electrical generator connected to the crank or the second flywheel, and an electrical motor connected to the first flywheel.

Albeit more mechanically complicated than the previous alternative, this solution has the benefit of obtaining a "spinner" action on the crank, as in real bicycles.

The apparatus may have an electronic gearing system controlling resistance in the crank and speed of rotation of the first flywheel.

The two alternatives mentioned above, with an electric connection between crank and flywheel, may have an electronic gearing system mimicking the action of a mechanical gear.

In a solution with an electronic gearing system, the resistance in the crank may be controlled by a braking device with an electromagnet or a power generator or dynamo with adjustable resistance, which affects the freedom of rotation of the crank or first flywheel or second flywheel.

A benefit of such a solution is that mechanical braking systems are avoided meaning less wear on components and less need of maintenance.

Another aspect of the inventive apparatus is that the second frame may be hinged to the first frame close to the floor level, with first motoring means controlling the incline/decline of the second frame relative to the first frame.

This means that the apparatus may behave more like an ordinary bicycle climbing or descending hills and slopes in the terrain.

The first motoring means may include an electric motor, an electric motor with gears or a hydraulic pump and cylinder.

The apparatus may also include a leg supporting the second frame, the leg being connected to the first frame in a position close to the centre of mass of the second frame.

This leg has the benefit that the rotational axis between the first and second frame may be positioned at will, i.e. sloping or horizontal. Also, the positioning of the connection near the centre of mass provides for stability in the apparatus.

The second frame may include a spring within a longitudinal part of said second frame.

With this design, a measure of flexibility may be added to the second frame.

The apparatus may also include second electronically-controlled motoring means in said axle connecting the second frame to the first frame controlling the tilt of the second frame.

This embodiment of the invention allows the second frame to be tilted by an external controlling means, in addition to movements induced by the user, for provoking the balance of the user.

The steering shaft may be connected with means for control of the second frame's tilt action.

This provides an additional element of realism to the ride.

The steering shaft may also be connected with a third electronically-controlled motoring means for controlling the turning of the steering shaft.

Again, this means an additional element of realism, as the apparatus may give the feeling of cycling in real terrain.

The training apparatus may also include means for centring said steering shaft around a middle position.

The training apparatus may also include sensors measuring the revolutions of the flywheels and crank for calculating the revolutions as a simulation of distance within a time unit.

An important aspect of the inventive training apparatus is that it may include a CPU, display means and sensors monitoring the position of the second frame relative to the first frame and the motions of the steering shaft and the crank and flywheel.

By the inclusion of the said elements for controlling the inventive apparatus, the invention may provide for efficient physical exercise of body and a realistic exercise experience which also include means for interacting with a screen showing tracks and a virtual environment. As such, the invention provides a complete stationary training apparatus or exercise bicycle with functions of controlled instability to stimulate a user's strength and which provides the user with advantages in regard to physical exercise, rehabilitation and prevention of injuries, and provides means for increasing balancing skills. The incline/decline function of the apparatus is fully automated and controlled through the CPU by any on-going programme, such as simulating a bike ride through a terrain with up and down hills. The tilt action is controlled by the user, turning the handlebar, and by shifting of body weight from side to side.

The CPU may be adapted to display a path in a terrain to be followed by the training apparatus on said display means, control motion of the first and second frame, braking of the crank and speed of the flywheel, the controller working interactively with a computer program.

The CPU may also be adapted to detect motions of the second frame induced by a user and adjust displayed images accordingly.

The CPU may also be set up for reading and adjusting the tilt and incline/decline of the second frame and the rotational motion of the handlebar.

Thus, the present invention discloses new solutions with regards to interaction with screen/computer, here also called interface console. Training programmes and online activities such as competitions are graphically shown on the screen, in real time and animated, whereas the apparatus moves and interacts accordingly, providing for incline motion and resistance which is dependent on the data for simulating chosen tracks and terrains.

The software of the bike enables the bike to navigate through terrain from map data as available from providers on the internet, which is created from satellite data, pictures and other images of the earth's surface.

An embodiment of the inventive training apparatus may include a power generator for creating resistance, the power generated through pedaling being supplied for charging any batteries supplied with the apparatus or with an external apparatus.

Then, the user's efforts when training may have an additional advantage, as the energy produced may have a practical use instead of being wasted.

In an embodiment of the apparatus using a mechanical coupling between crank and flywheel, a vertical arm and ball joint-driveshaft may be used for connecting the first flywheel to the steering shaft, the ball joint-driveshaft being connected to a cog wheel driving said belt.

This solution may allow the flywheel to be mounted in a stationary bearing, with a flexible connection to the steering shaft and handlebar.

The ball joint-driveshaft may be connected to a motor, dynamo or eddy-current braking device.

The training apparatus may also include gearshift levers located on the handlebar, the gearing action being shown on a display or screen.

The apparatus may include an interface console with the display means, which is supported by a bracket fixed onto the handlebar steering shaft or onto the upper frame.

The interface console may be a general purpose computer or laptop, and wherein it can be removed from the apparatus and used for other purposes than when used with the apparatus.

This provides for a very flexible solution allowing a user to use a personal computer with a personal training program installed.

The inventive training apparatus may also include fans for generating an illusion of wind or for pure cooling.

The fans may provide additional realism and comfort.

BRIEF DESCRIPTION OF THE DRAWINGS

Several embodiments of the invention will now be described in detail in reference to the appended drawings, in which

FIGS. 14*a* and 14*b* show a variation of the embodiment shown in FIG. 10.

DETAILED DESCRIPTION

Figure 1:
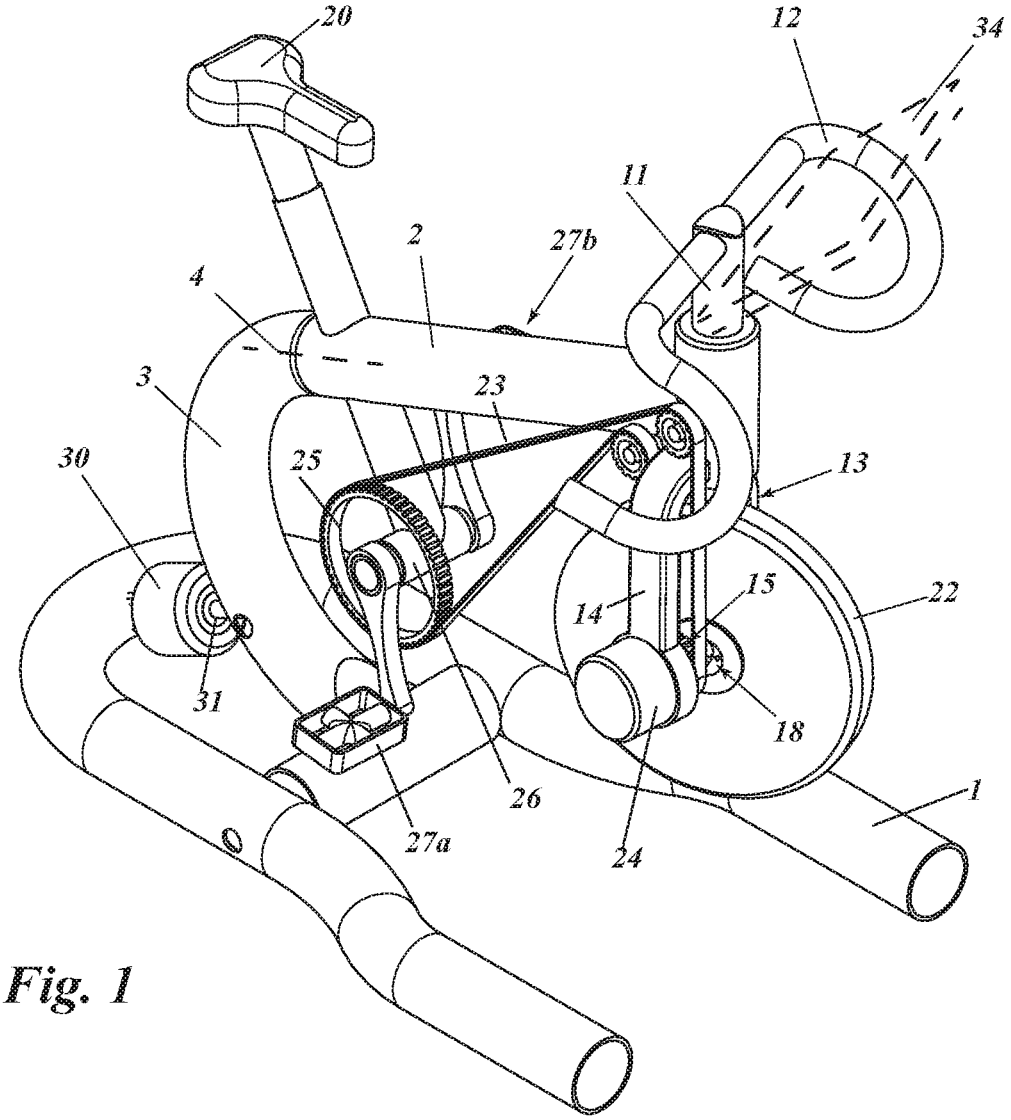
FIG. 1 shows a perspective ISO drawing of the invention.

FIG. 1 shows the inventive training apparatus, or more precisely an indoor stationary exercise bicycle, with a lower first frame 1 configured to be supported on a floor and a second upper frame 2 which is tiltable relative to the first frame 1. The second frame 2 is rotary connected to the lower frame 1 which has a stiff axle 4 (dashed line) located at the rear end thereof onto which the upper frame 2 is connected, the axle 4 being dimensioned to carry all the weight and load of upper frame 2 along with the handlebar 12, steering and tilt mechanism, seat 20, flywheel 22, resistance mechanism (motor/dynamo/eddy current) 24, crank 26 and pedals 27*a*, 27*b* etc, and all other parts, plus the weight of user, the construction being cantilever. The axle 4 (dashed line) is cantilever placed at an incline towards the front end of the apparatus. The construction is based on what is disclosed in WO2007/055584, FIG. 16a-b.

Figure 2:
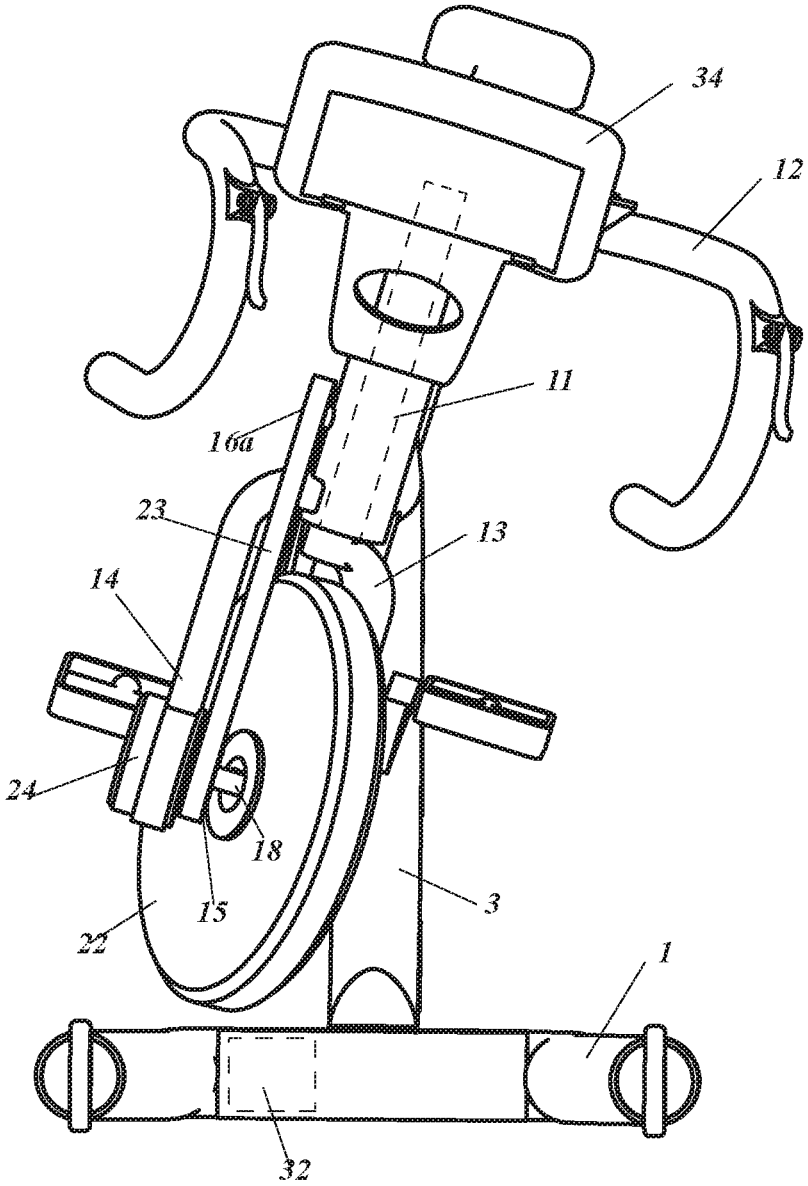
FIG. 2 shows an embodiment of the invention in frontal view disclosing a tilt action and turning of the handlebar and flywheel.

The handlebar 12 is connected to a steering shaft 11 which continues as an arm 13, see FIG. 2, carrying the flywheel. To the upper frontal part of the frame, there is also fixed a vertical arm 14, on the opposite side of the flywheel. This supports a first cog wheel 15 which is fixed to a ball jointed shaft 18 connected with the flywheel. A belt 23 connects the first cog wheel 15, through secondary cog wheels 16*a*, 16*b*, to a second cog wheel 25 at the crank 26. Also connected to shaft 18 is means of resistance 24, such as an eddy current unit or preferably a controlled dynamo/electric motor.

Figure 4:
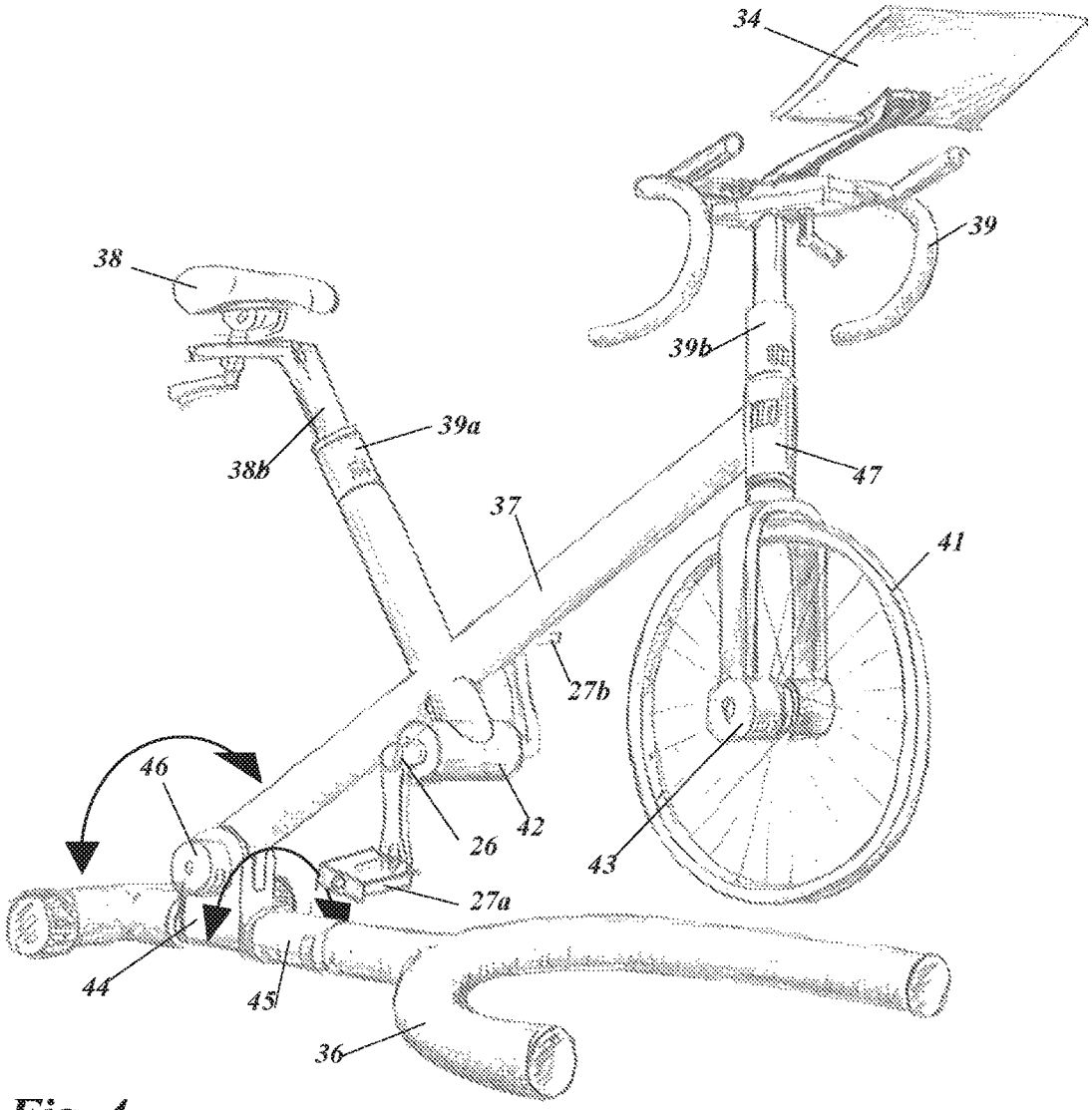
FIG. 4 shows a perspective drawing of a second embodiment of the invention.

A second embodiment of the invention is shown in FIG. 4. In this embodiment there are no cog wheels or belt. The crank motion is read by a sensor which sends signals to the CPU of an interface unit 34, and which again activates the motor connected to the flywheel for rotation. Resistance is created by a dynamo/electric motor connected to the crank.

The interface unit which includes a CPU and screen is shown in FIGS. 1 and 3 only by dashed lines. The interface unit is shown as 34, in FIGS. 4 and 50 in FIG. 5.

The flywheel will have a size and weight which will produce a given velocity at a high rotational speed. The spinning flywheel will stabilize the upper frame from tilting and the user will feel gyro forces on the flywheel when turning the handlebar.

Compared with the applicant's prior art listed above, the invention here disclosed includes auto mechanical movement of incline and decline motion. This allows for the user to exercise through interaction with an on screen program and a virtual reality. As seen in FIGS. 1, 3*a*, 3*b* and 4 there is a motor 30 which controls the incline motion interactively dependent on exercise and computer program.

The means for adjusting the incline may comprise of a motor, preferably electric, a motor with gears, or a hydraulic system. As suggested on FIG. 1, 30 is a motor which drives a gear and rod 31 which is located on the base frame 1 and connected with frame section or curved leg 3. The motor is activated for incline and descent motion and controlled by the computing means of the invention.

The incline/decline controlling motor may be located somewhere else or connected differently within the construction, still being within the scope of the invention. As denoted 32 in FIGS. 2 and 3*a*, the dotted circle/box suggests locating a motor directly on the axis of vertical motion, in the same manner shown in FIG. 4.

The following will describe the mechanical solutions used for performing the incline and decline motion of the invention.

As disclosed in FIGS. 1, 2, 3*a* and 4, the apparatus of the invention has a vertical leg 3 connected to the base frame 1. A motor 30 and rod 31 is fixed to the lower rear part of frame 1 and connects to leg 3. Activating motor 30 will push or pull rod 31 to raise or lower the upper frame 2, as indicated by arrow 34 so to simulate an incline or decline motion which is part of an interactive program shown on the screen 52, which will be disclosed below relative to FIG. 5.

FIG. 2 shows a frontal view of the invention where the upper frame is tilted and the handlebar and flywheel are turned.

Figure 3A:
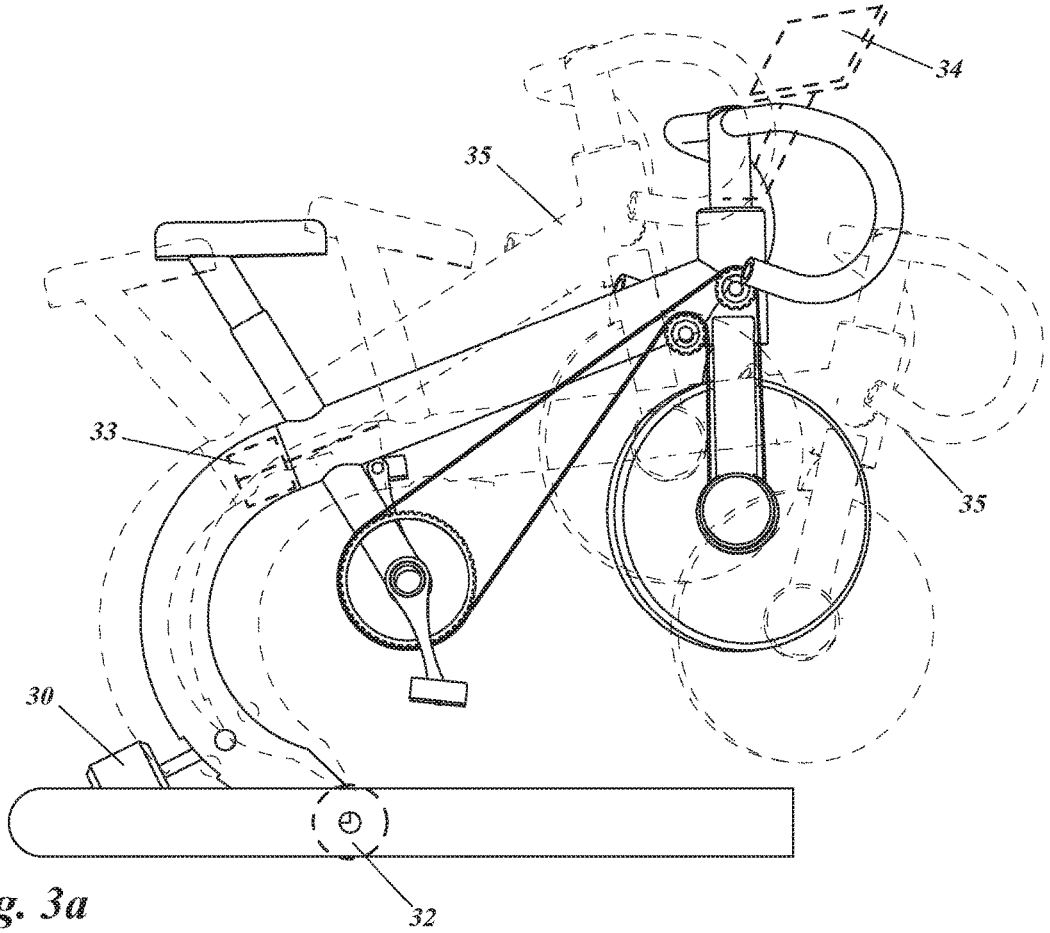
FIGS. 3*a* and 3*b* show side and top views of the embodiment in FIG. 2.
Figure 3B:
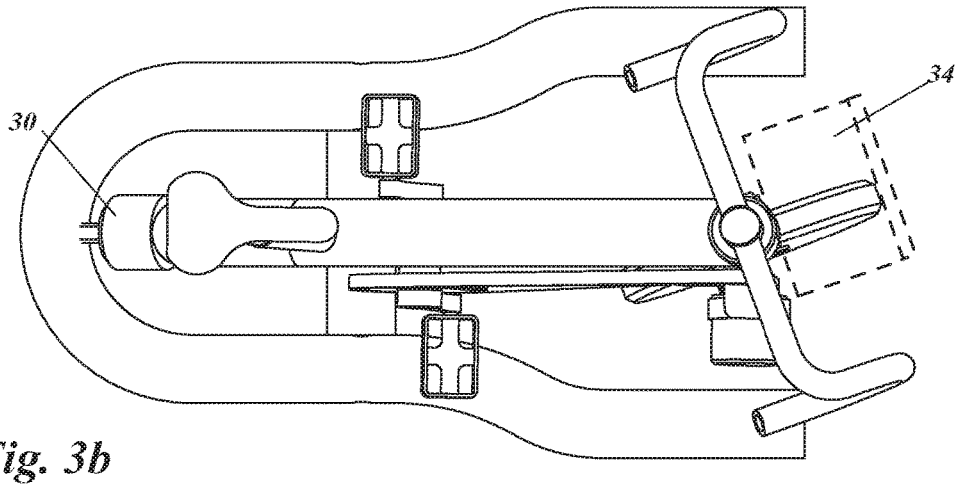

FIGS. 3*a* and 3*b* show a side and top view of the invention, the handlebar and flywheel turned towards the left.

Figure 9:
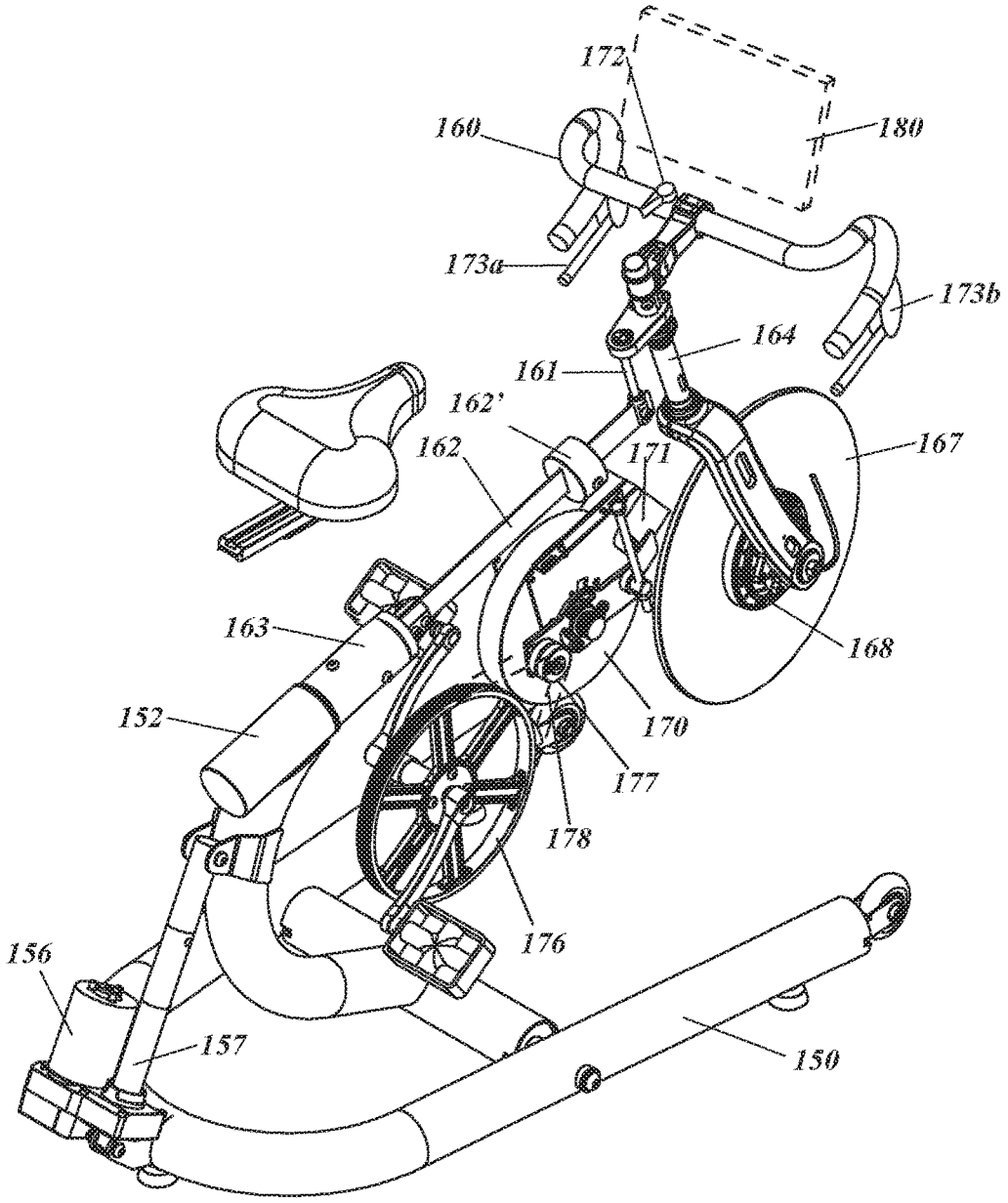
FIG. 9 shows the third embodiment in further detail.

The resistance mechanism may be connected with an interface console, numeral 50, FIG. 9, preferably having a computer unit and a screen (as shown in FIGS. 1, 2*a*, 4), from where a user would monitor and adjust tasks and options, the system also having a sensor which reads the rotation of the pedaling action and/or flywheel.

FIG. 4 shows a perspective drawing of a second embodiment of the invention.

This embodiment shows a fully automated version of the invention as there is no mechanical link between the handlebar and tilt mechanism, crank and flywheel or handlebar and flywheel. A lower frame 36, for placing on a floor, supports an upper frame 37, which has a crank 26, pedals 27*a*, 27*b*, seat 38, handlebar 39, interface console 34, flywheel 41, and means of motors and sensors for the unique motion of this inventive apparatus. A bracket 44 is rotary connected on the lower frame 36 and connected with a motor 45 for tilt motion of the upper frame 37. The upper frame 37 is rotary connected to the bracket 44 and is connected to a motor 46 for vertical motion as incline and descent. The crank is connected to means of resistance 42, such as a generator, and the flywheel 41 is connected with a motor for rotary motion. The rotation of the crank is monitored by sensors which are connected to the CPU of the interface console which activates the flywheel rotary motion accordingly, as if there were a belt connection. Turning motion of the handle bar will turn the flywheel, the motion controlled by motor 47.

The length of the seat pole 38*a* is adjustable by activation of a motor 39*b*, the height of the handlebar adjustable by activation of motor 39*b*.

Every motion of this embodiment of the invention is controlled by a CPU within the interface console 34. By means of control elements, as suggested in FIG. 6, such as the use of a touch screen, and from software programs, the apparatus will behave as for a real bicycle on road or in terrain.

When the screen shows inclining terrain the upper frame will incline accordingly. Descending down a hill as shown on the screen will make the upper frame descend accordingly. Any uneven surface as a result of the program will trigger the motor connected with the handlebar and motor controlling the tilt to challenge the user's ability to balance the apparatus and keep on track according to what is shown on the screen.

The interactive system of the invention will now be described with reference to FIG. 5.

Figure 5:
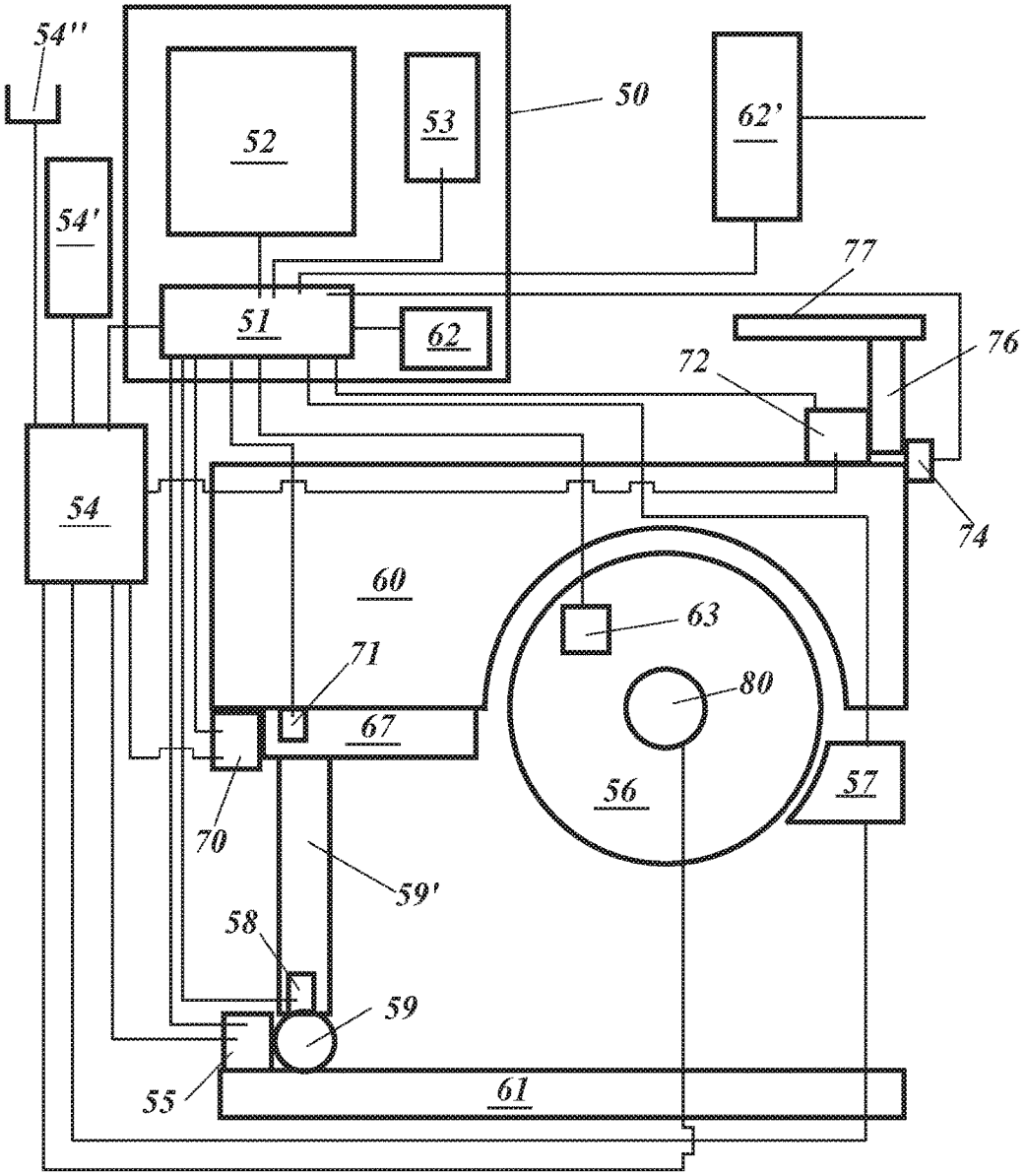
FIG. 5 shows a block schematic of the invention.

FIG. 5 shows a block schematic which illustrates the design and interface structure of the invention. An interface console 50 (34) comprises a CPU 51, means for display 52 and input 53. Power controller 54, which controls power from batteries 54' or from the mains 54", is connected with the CPU 51 which controls the power controller's distribution of power to motor or drive means 55 (30) for incline descend adjustment, and resistance 57 to flywheel 56 (22). A sensor 58 is located at the rotational means 59 (axis 4) on the bicycle frame for reading of the incline angle. The motor 55 may be ordered from the interface console 50 to adjust frame support, 59' and the incline of the apparatus frame 60 (2). This applies to a function making different angles of the upper frame 60 for simulating a movement of the apparatus cycling up and down hill, as for a mobile bicycle on a road or in terrain. The CPU of the apparatus will have a variety of programs 62 which simulate different tracks and terrains. The CPU will order motor 55 (30) to adjust incline according to for instance a terrain program it is simulating, and signal resistance mechanism 57 to add resistance when a hill climb is run in the program. The resistance mechanism 57 can be of an electromagnetic type, such as an eddy-current brake system.

The user may adjust the exercise apparatus to any desired resistance independent of any programs using the interface console 34/50, which has a screen and means for input, the mechanism creating resistance 57 being activated at desired level. The exercise apparatus also has a sensor 63 which detects the revolutions of the flywheel 56, and which is connected to the CPU 51 for computing the revolutions to simulate distance, and to compute amount of training relative to a time schedule.

The rotation of the flywheel may also be fully electronically controlled, as suggested in FIG. 4, as the rotation of the crank is read by the computer which then controls the flywheel by wire. This will be discussed in further detail with reference to the embodiments described in FIGS. 8-10 below.

In an embodiment of the invention, which is suggested to be fully automated, the manual tilt mechanism as disclosed in prior art is replaced by motor-assisted means as indicated in FIG. 3*a*, dashed line 33 and 70 FIG. 5.

As disclosed in FIG. 5, the handlebar 12 (77) and handlebar rod 11 (76) are connected with motoring means 72 which is designed to give resistance to the handlebar and/or to rotate it. This is according to data from program executed by the CPU. The CPU is also connected with a sensor 74 which reads the rotational position of handlebar rod 11 (76).

A sensor 71 reads the tilt motion of the frame 2. The tilt motion according to this fully automated embodiment is initiated by motor 70 upon signals from the CPU which has processed data according to a program and to movements made by the user on the handlebar and upper frame.

The data from frame tilt and rotational position of the handlebar is processed by the CPU according to any program running (for example an off road race in rough terrain) and the position and action of the user. This feature provides the invention with simulation of either a bicycle or a motorbike and for example cycle-manoeuvring through tracks and terrains and will add rotational resistance and force feedback to the user according to a program. This feature enables the steering to be independent of the actual tilt action but dependent on the actual program and manipulation by the user. The motion of the handlebar therefore does not solely depend on the balancing skills of the user but may also control directional steering action according to the computer program which is running.

Also shown in FIG. 5 is a generator 80 for generating electricity and added resistance. This may charge a battery 54' and drive the whole apparatus independent of mains power supply 54" and or charge parts of the apparatus, as computer batteries. The power can also charge any batteries supplied with the apparatus or connected to the apparatus, such as a PC, MP3 player and/or mobile phone. This generator may be formed by the afore mentioned means for generating resistance in the crank.

Figure 6:
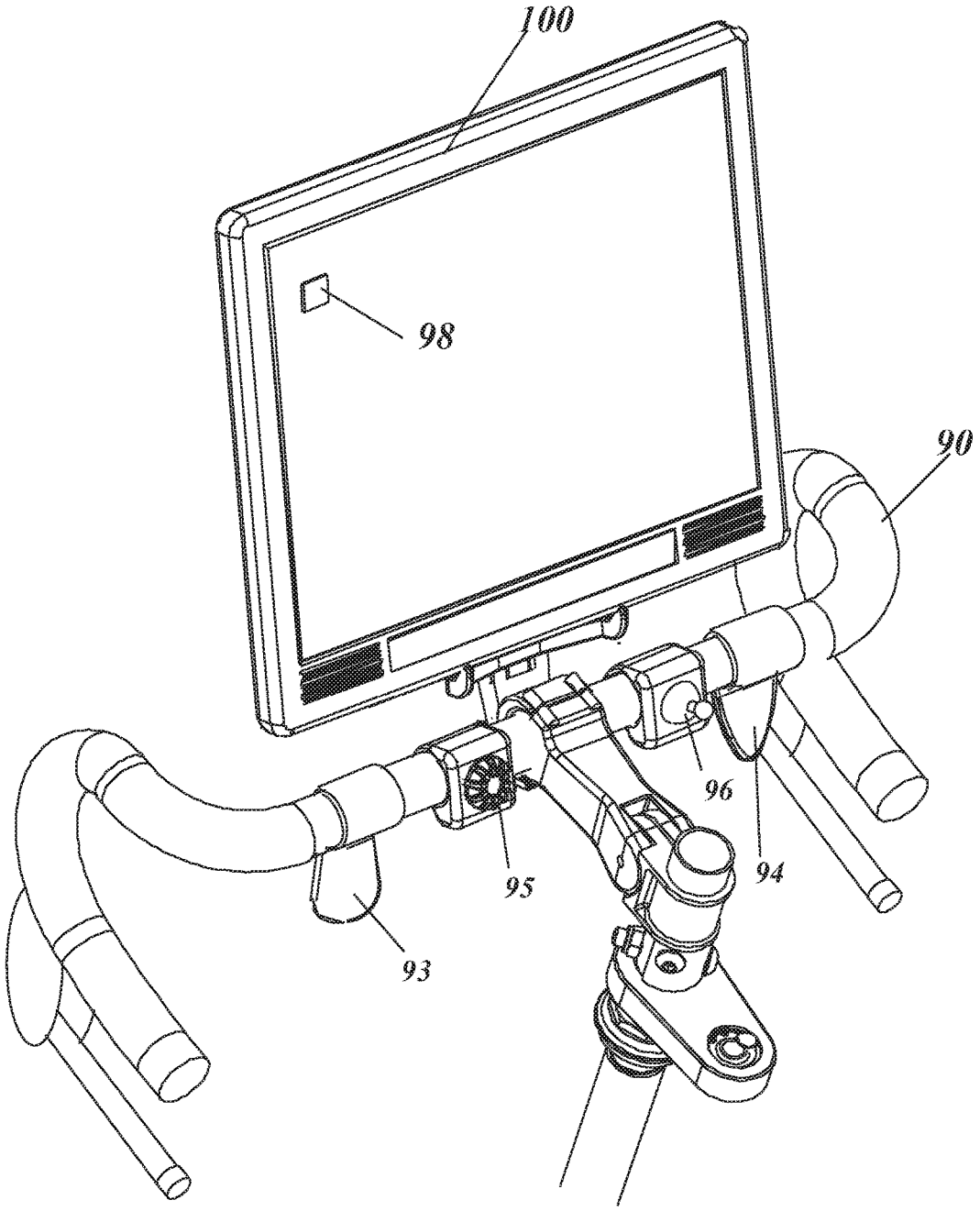
FIG. 6 shows the handlebar of the invention with means for manual input control and gearshift.

FIG. 6 shows means for input, control and gearshift, by a user, fitted to the handlebar of the present invention. The handlebar 90 has left and right gearshift levers 93, 94 which change the ratio between the crank and the pedal resistance, and a flywheel disclosed in the description above related to FIGS. 1-5, or a generator as will be disclosed below related to FIG. 5. FIG. 6 also shows a screen 100 which may be of a touch screen type. Additional control and input keys 95, 96 are also fixed to the handlebar. Key 95 represents a multifunctional press and rotational key for navigating a cursor or pointer 98 on a screen. Numeral 96 represents a joystick. It should be noted that the invention may include any input and control devices as for instance a touch screen, touchpad, keyboard, buttons, button clusters, multifunctional keys, joysticks, mouse etc.

Figure 7:
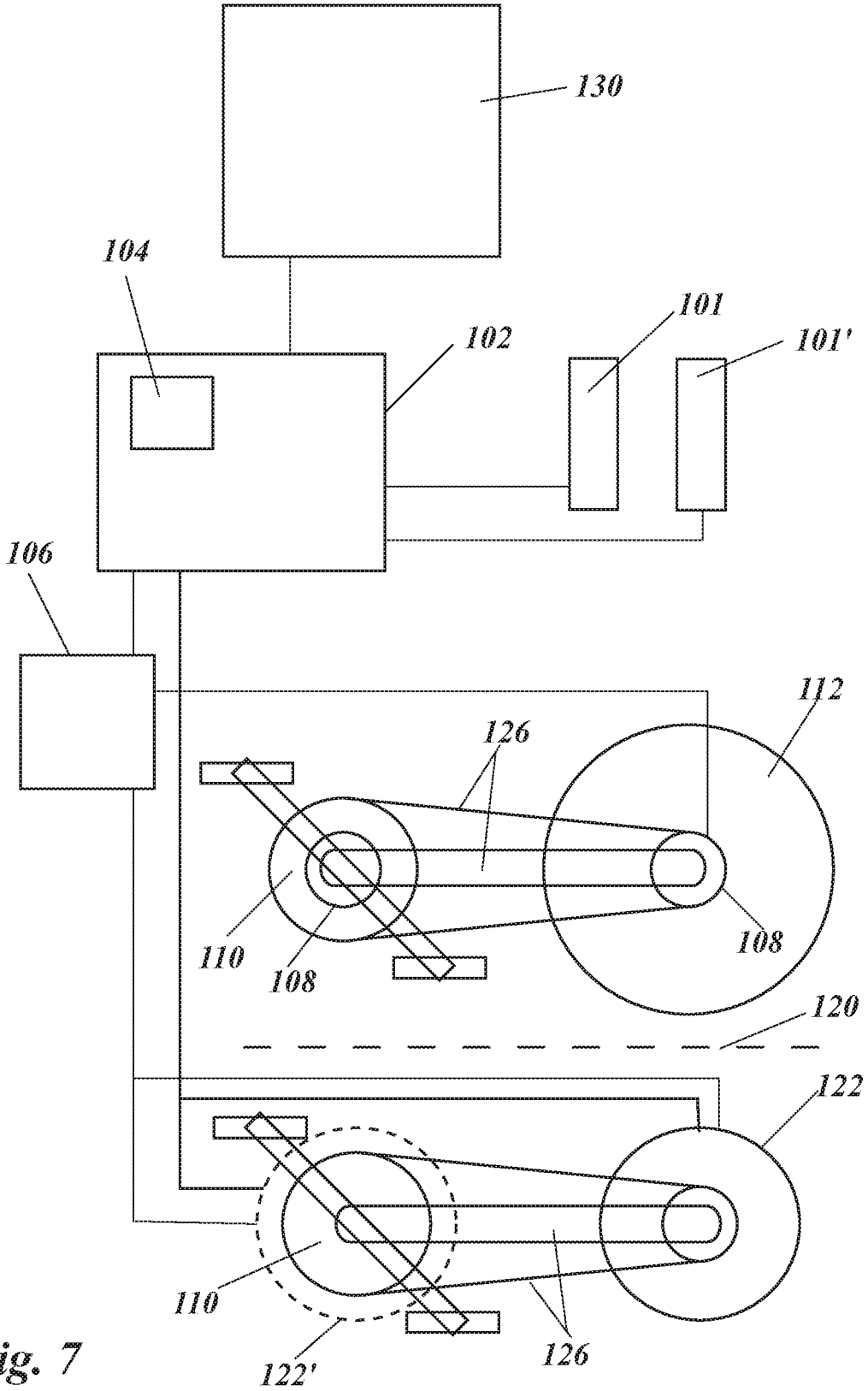
FIG. 7 shows a block schematic illustrating the gearing system used in the invention.

FIG. 7 shows a block schematic illustrating a gearing system of the invention which is electric and/or electronically assisted. The gearshifts 101 (93), 101' (94) are connected with a CPU 102 through which a programme 104 controls a gear actuator 106. The gear actuator 106 changes gears or controls a gearbox 108 fixed on crank 110 or drive wheel (flywheel) 112, which is connected by chain, belt or driveshaft 126, in order to change the ratio between them. In a fully electronic system, as will be further disclosed below with reference to FIGS. 8-10, gear shifts are fully controlled by the CPU and program, whereas the crank and spinning flywheel are connected by wire, thus the ratio between the crank and flywheel is simulated by the revolutions made by a hub motor on flywheel and resistance made to the crank by generator or electromagnetic brake system.

As indicated below the dashed line 120 in FIG. 7, an embodiment of the inventive training bike includes a generator 122, 122' connected with the crank 110 through a drive chain, belt or shaft 126 or connected on same axle as the crank. Data related to the generator and using the training apparatus is shown on the screen 130, in this case data related to speed, rpm, gear and gear ratio.

Use of generators enables creating resistance force which generates electricity that may be stored in a battery. The degree of resistance is controlled by the CPU and dedicated software. As disclosed above, any software program will graphically show animations on the screen of the inventive apparatus, of for instance a track, terrain environment etc, which interacts with motions of the apparatus. This means that the generator in this setting will give resistance during an uphill simulation and run as an electric motor when the program is simulating a steep downhill where the user is pedaling slower than simulated speed. Different gears are also simulated using shifting levers 93 and 94, FIG. 11. The CPU is "told" to give impulses to the generator in order for it to change resistance so as to simulate the chosen gear.

Figure 8:
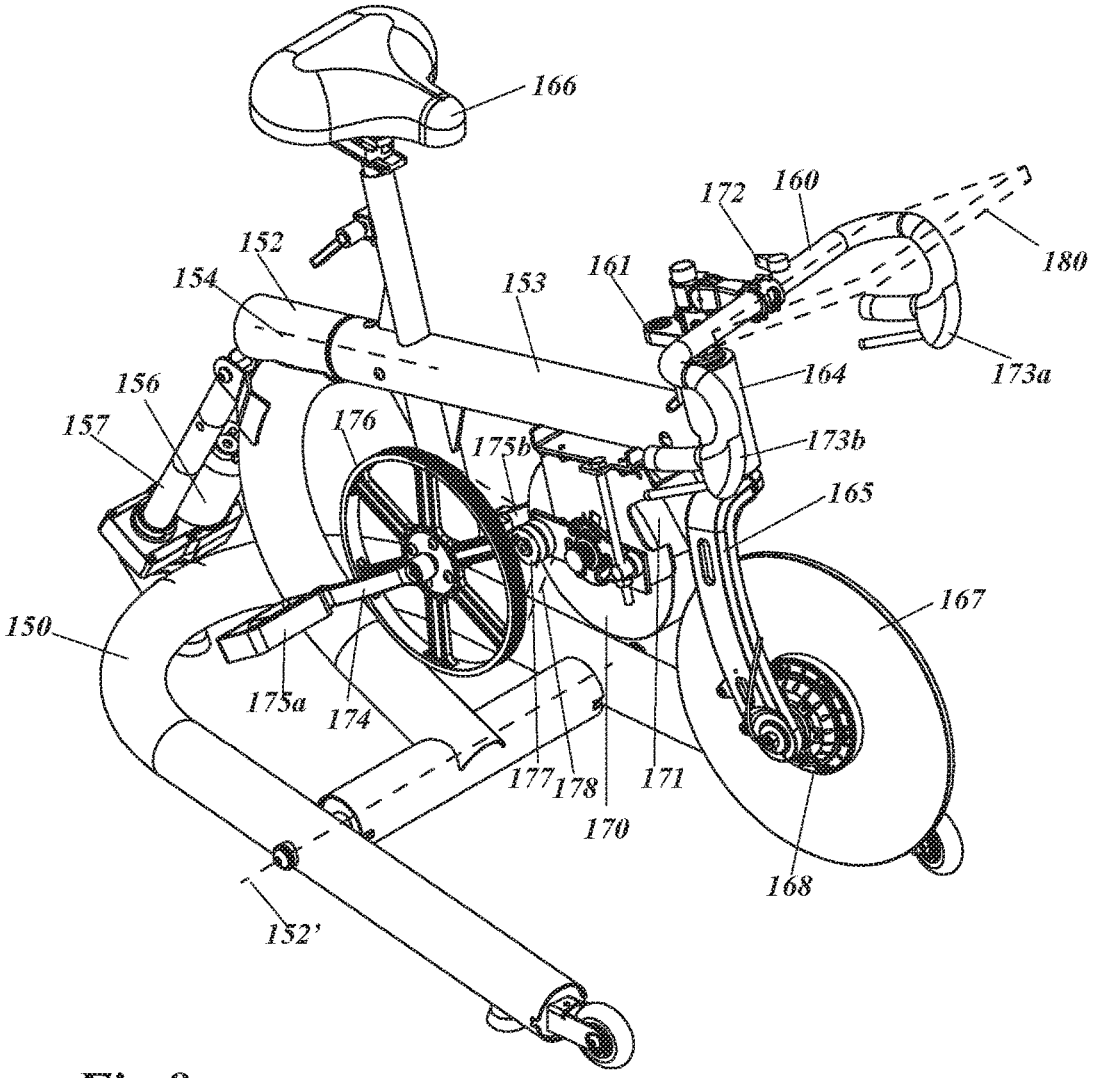
FIG. 8 shows a perspective drawing of a third embodiment of the invention.

FIG. 8, 9 show a third embodiment of the inventive training apparatus similar to what is disclosed above with reference to FIG. 1. The embodiment has a lower first frame 150 configured to be supported on a floor and a second upper frame 153 which is connected to the lower frame 150 via a curved column 152 which at the lower end is rotary connected to the frame 150, and through axis 152' enabling an incline and decline motion of column 152 and frame 153, by use of motor and actuator 156 and 157.

Connected to the upper part of column 152 is an assembly (bearings etc.) 163 onto which the upper frame 153 is connected, the assembly 163 dimensioned to carry all the weight and load of upper frame 153 along with the handlebar 160, steering and tilt mechanism 161 (see FIG. 10), seat 166, first flywheel 170, resistance mechanism (motor/dynamo/eddy current) 171, crank 174 and pedals 175*a*, 175*b*, second flywheel or gyro wheel 167 and hub motor 168 and other parts, plus the weight of the user, the construction being cantilever. The screen and console 180 are supported by a bracket 159 (shown in FIG. 10) fixed to handlebar shaft 164, thus making the screen follow the rotational motion of the handlebar. The axis 154 (dashed line) of the upper frame 153 is cantilever placed at an incline towards the front end of the apparatus. The upper part of the inventive apparatus will have a rotary function on this axle enabling a tilt motion transverse the longitudinal length of the whole apparatus, in the same manner as illustrated in FIG. 2.

Figure 10:
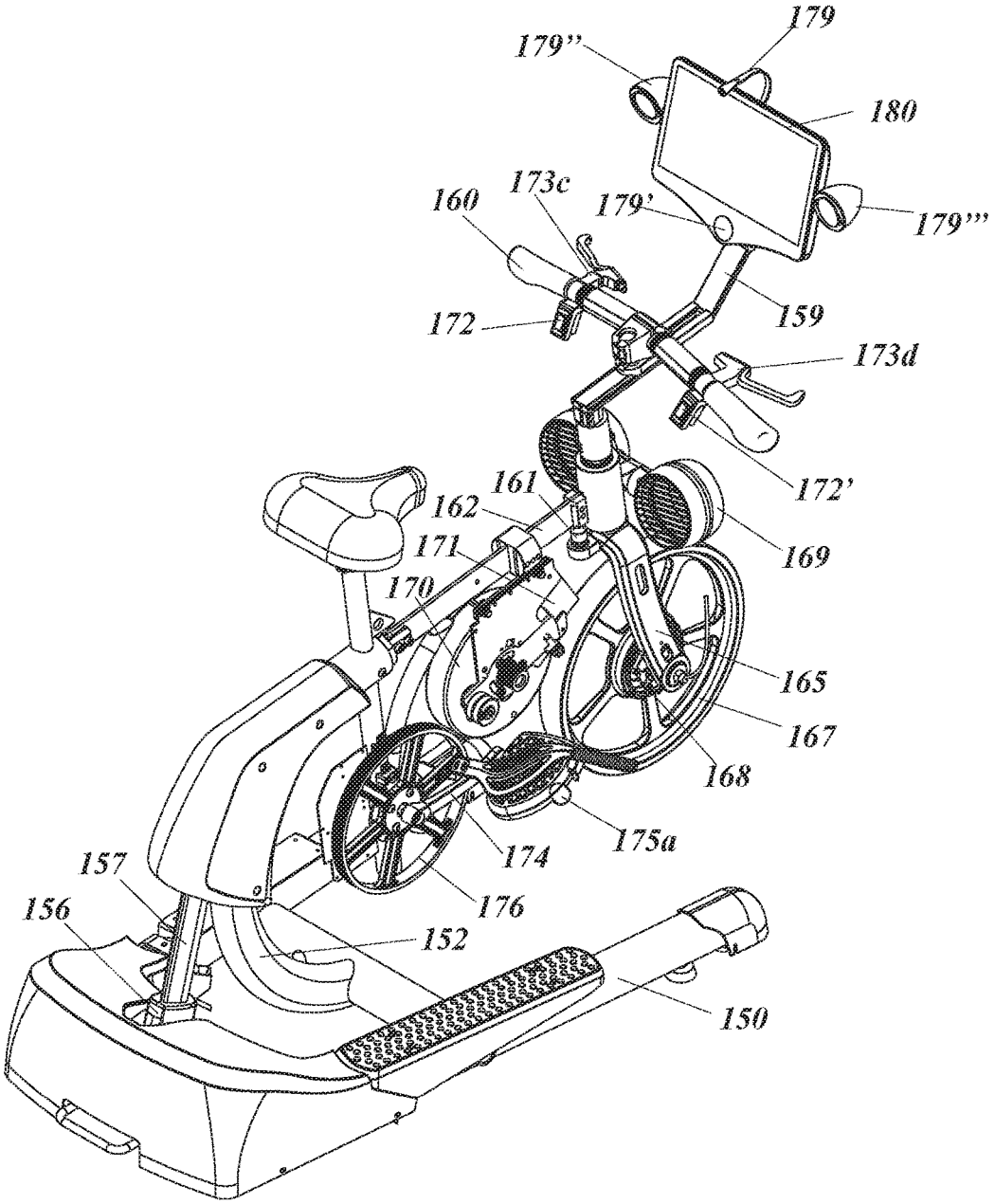
FIG. 10 shows a variation of the third embodiment.

The tilt motion can be manipulated as the handlebar shaft 164 is connected with a lever 161 connected to a spring 162, which in turn is connected to the rear upper column assembly and therefore non rotational on the axis 154, which is illustrated in FIG. 10 where part of the upper frame 153 is removed. When the upper frame 153 tilts to one direction the handlebar will turn likewise. Turning the handlebar in the opposite direction of the tilt will force the frame upright as lever 161 grips with the firm but somewhat flexible spring 162. The degree of flexibility of the spring is determined by its length which is adjusted by positioning a block 162', which grips around the spring, along the length of the spring, thus shortening or lengthening the spring.

The handlebar 160 is connected onto a rod 164 (FIG. 10) which is connected to arm 165, carrying a second flywheel or gyrowheel 167. To this wheel is connected an electric hub wheel motor 168 which drives the wheel when crank is rotated. This is done electronically as will be further disclosed with reference to FIG. 10.

The electric motor will give speed and velocity to this wheel 167 which in turn will create gyro forces. These forces will assist in stabilizing the inventive bike apparatus when in active use. The gyro forces will also give resistance to the user when the handlebar is turned.

A flywheel 170 and the electronic magnetic brake system 171 are connected with the crank 174 and cog wheel 176 to cog wheel 177 via belt 178 (dotted lines) which creates resistance to the user when pedaling. The degree of resistance as described above is a result of the desired training programme, the rotary action of the crank read by a sensor, making the CPU activate for rotation of flywheel 167. As disclosed above in this case, the gear shifts are fully controlled by the CPU and program, whereas ratio between the crank and flywheel is simulated by the hub motor on flywheel and resistance made to the crank by the brake system. Gear knob is numbered 172, brake handles 173*a* and 173*b*.

FIG. 10 shows an embodiment of the invention similar to what is disclosed in FIGS. 8 and 9. However the lever 161 is here connected to the spring 162 from below. The embodiment also shows a different handlebar (160) configuration whereas gear change buttons 172, 172' are available on each side close to handlebar grips. The handlebar shown is of a type used on off road bikes, with brake levers 173*c* and 173*d*. The screen and interface console 180 here disclose a camera 179, microphone 179' and speakers 179" for audio-visual communication.

The front flywheel has preferably the most mass diametrical away from centre as shown in FIG. 10.

The embodiment also shows a pair of electric fans 169 which can simulate wind resistance and/or cool the user.

Figure 11:
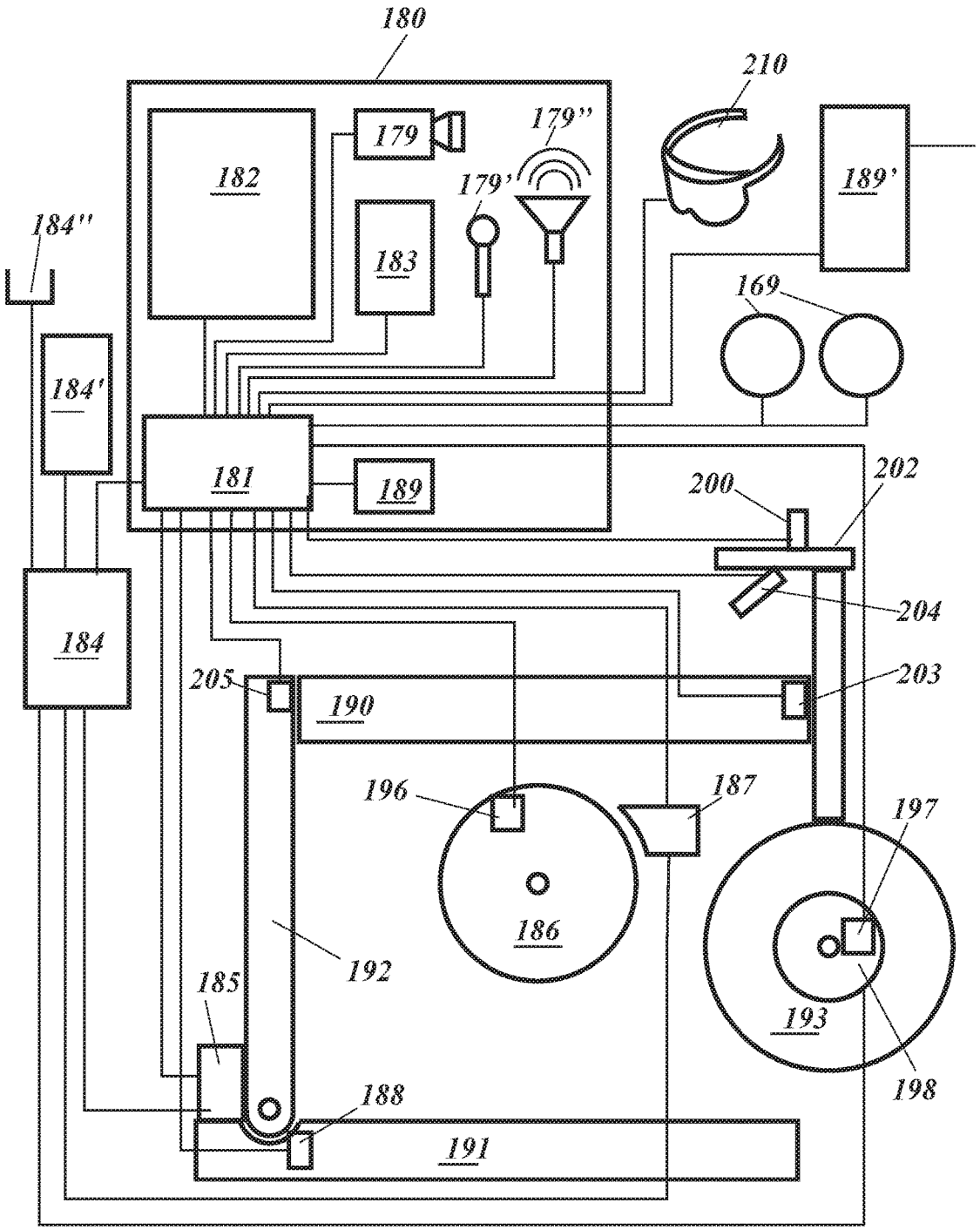
FIG. 11 shows a block schematic of the third embodiment.

FIG. 11 shows a block schematic for an overview of the inventive bike according to the invention and especially embodiment disclosed in FIGS. 8-10.

The interface console 180 comprises a CPU 181, means for display 182 and input 183. Power controller 184, which controls power from batteries 184' or from the mains 184", is connected with the CPU 181 which signals the power controller distribution of power within the apparatus as the motor or drive means 185 for incline and descent adjustment and the resistance 187 onto a first flywheel 186. A sensor 188 is located at the base frame 191 for detecting motion on leg 192 for reading of incline angle. The motor 185 receives signals from the interface console 180 to adjust incline of frame support 192, and the apparatus frame 190.

The CPU 181 of the apparatus will read from programs 189 which simulate different tracks, terrains and environment, either pre-installed or streamed from a local server or an online internet connection live 189'. The CPU will signal motor 185 to adjust incline according to for instance a terrain program it is simulating, and signal resistance mechanism 187 to add resistance when for example a hill climb is run in the program.

The flywheel 186 is powered by the user when pedaling, the crank connected with the flywheel as shown in FIGS. 8 and 9. The rotation and speed of the flywheel 186 is read by sensor 196 and the rotation and speed of the second flywheel 193 is read by sensor 197. The second flywheel 193 has an electric hub motor 198 which is activated upon rotation of flywheel 186.

More specifically, when the sensor 196 detects rotation of flywheel 186, the computer 181 signals motor 198 for rotation of second flywheel, or gyro wheel 193. Sensor 197 monitors the speed of the wheel 193 and the computer signals the motor 198 according to speed of flywheel 186 and according to the training program. For instance if there is a downhill in the program and the user stops pedaling, flywheel 186 rotation speed will slow down, and even stop, but the wheel 193 will continue, or increase rotation as the computer will signal the motor to work according to the program.

The apparatus according to the invention also has means for gearing as disclosed above in FIG. 7. For the present embodiment the selection of gears, where gear selector 200 is illustrated on handlebar 202, will generate more or less resistance on to flywheel 186. The rotation of wheel 193 however is dependent on the speed within the interactive program which is running, for instance biking at 35 kilometers an hour along a road, pedaling fairly slow using a high gear ratio.

Brake handle 203 will generate a signal to the computer to slow down and/or stop both flywheels.

The transfer of gearing and analogue/digital transfer of gearing and braking may be configured in an analogue manner by use of wires. This only applies if the brake and gearing are mechanic. The embodiments showing electronic braking and gearing will be preferred and will demand digital/electronic transfer of signals.

Turning of the handlebar which also physically will turn wheel 193, is detected by sensor 204 and will guide riding a bike within an interactive program, say following a road and biking round a bend.

A sensor 205 is located on column 192 in order to detect tilt, or swing motion of the upper frame 190. This motion is computed and graphically represents tilt motion within the running program.

Any sensor for analogue or digital detection of changes in angle may be used although in most cases Hall sensors (magnetic field sensors) are preferred. Optical sensors will also work for detection of motion.

The invention also claims to be beneficiary when utilising 3D graphics on screen or using virtual reality (VR) goggles or head/helmet mounted display (HMD).

3D movies or games displayed on VR goggles or HMD have the effect of making many users dizzy. Many persons even react when watching 3D movies in theatres.

A study from 2012/2013 titled: *Prospective Crossover Observational Study on Visually Induced Motion Sickness*, by Angelo G. Solimini for Department of Public Health and Infectious Diseases, Sapienza University of Rome, Italy, concluded that seeing 3D movies can increase rating of symptoms of nausea, oculomotor and disorientation.

The study explained that several adverse health effects can be induced by viewing motion images, including visual fatigue and visually induced motion sickness, the latter explained as nausea disorientation (dizziness, vertigo, fullness of head). These symptoms are conditions that may be onset during or after viewing dynamic images while being physically still, when images induce in the stationary spectator an illusion of self-movement. There is thus a mismatch between the visual and the proprioceptive stimuli. The visual system feels vection while the proprioceptive systems do not transmit signals consistent with motion.

The motion of the present inventive apparatus is interactive with any ongoing action and movement displayed graphically on the screen. This interaction between the user, apparatus and motion graphics, even in 3D, prevent the user from getting ill.

Numeral 210 indicates virtual reality (VR) goggles or head/helmet mounted display (HMD). Using this as means of display will increase the user experience. There has as mentioned introductory, been a problem using this type of equipment, especially when showing moving graphics in 3 dimensions, making the user dizzy at the least. However the apparatus of the invention moves interactively with the graphics so that dizziness and nausea will not occur during normal use or be more problematic than when biking and driving a car in real life.

The invention also has audio and visual means for communication, either between user and a software program or with other users through an online connection as illustrated by numeral 189', the means in addition to screen 182, are camera 179, microphone 179' and speakers 179".

Map and terrain data of the earth is today available from many players which collect data from satellites, aeroplane pictures/film, ground view pictures/film etc., and disclose maps and images of the earth's surface and civilisation on the internet. The invention utilises such data in order to navigate in the terrain and to create an animated graphical environment which is shown on the screen of the invention.

Coordinates from geographical data are gathered in order to make tracks which the user may choose to follow interactively as a training session.

Figure 12:
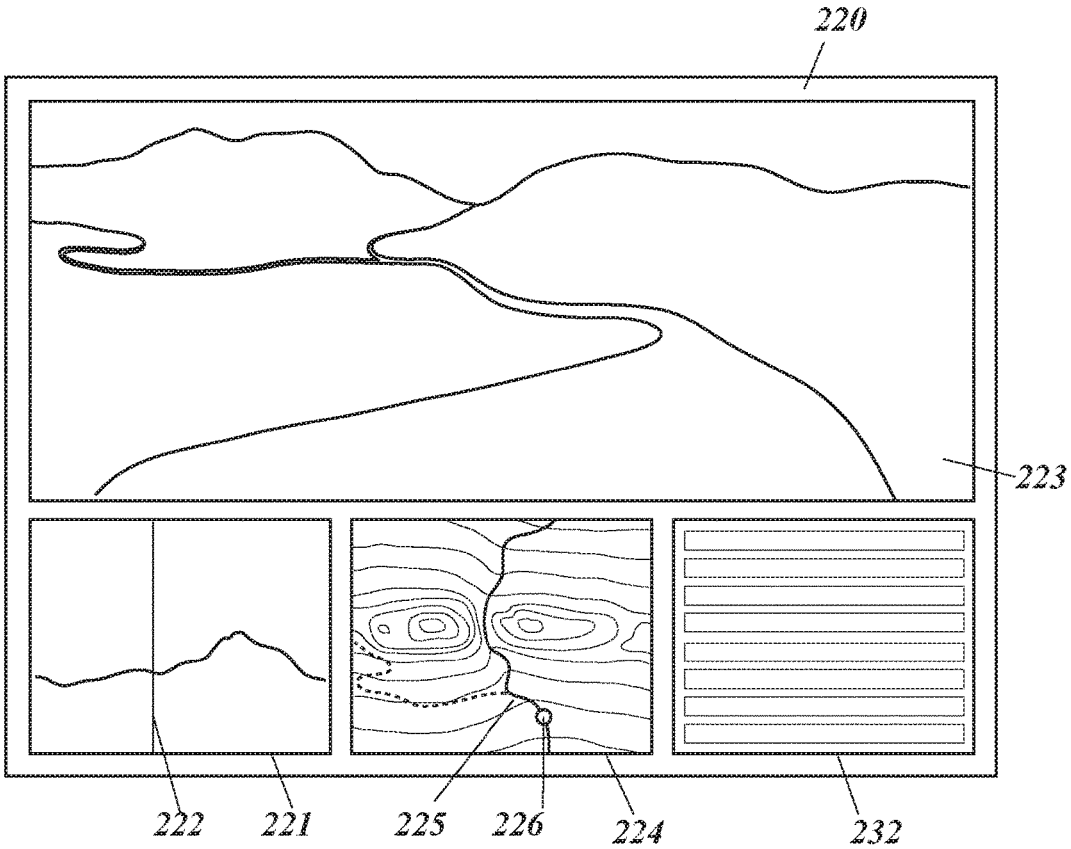
FIG. 12 shows a screen view when operating in an online environment.

As illustrated in FIG. 12, the screen 220 (31, 82) of the invention displays a chosen terrain with a choice of functions and views. Altitude data and track profile are gathered from the map/satellite data processed and shown on the screen in a separate section 221, the current position of the user along track shown as 222. Another view 224 shows a bird' eye view of the terrain, as a 3 dimensional (3D) image or film or as a traditional map, showing the tracks and roads 225 of which to choose and follow, the position of user shown as dot 226. A preferred view, shown as section view 223 which could cover the whole screen if desired, shows a 3D graphical representation of the actual terrain following the chosen roads as an animated representation of or a real film of the actual terrain.

This view is not available if only map and satellite data is available. The view along the track will in this case have been filmed or animated based on geographical data.

Section 232 illustrates a section for where information to user can be located. Layout for the graphic presentation is however dependent on what information is available and necessary for the performance of the training exercise chosen by the user. In a full screen view of the terrain in 3D, as 223 illustrates, information can be located at the bottom or top of the screen, or in boxes or sections anywhere on the screen.

Figure 13:
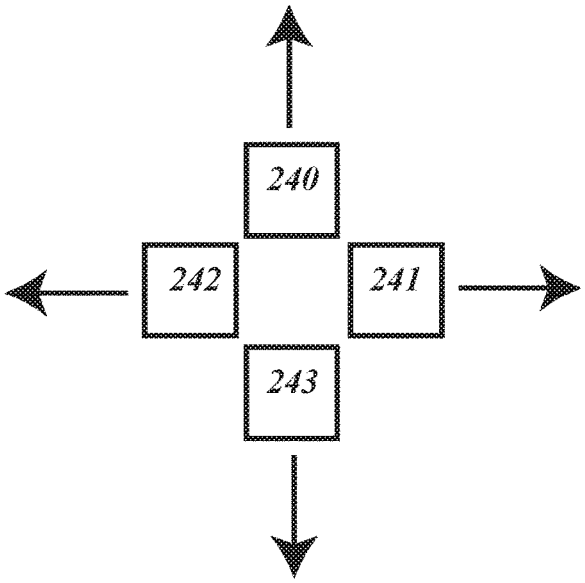
FIG. 13 illustrates schematically the orientation of bike functions relating to simulation of terrain orientation.

The functions of the inventive bike are used for navigating a simulated bike ride through a graphical environment. Using a computer for navigation through an animated computer game works by using mouse and or arrow keys on the keyboard. The bike functions in a defined setting or program replace the keyboard navigation keys. In the example shown in FIG. 13, pedaling 240 activates a forward and speed function, turning the handlebar activates for right 241 and left 242 turn (and view) and braking and or pedaling backwards 243 for retardation of speed and stop.

As disclosed above the spring 162 is linked to the handlebar steering rod 164 and limits the handlebar rotation and aids the user to balance the tilt motion. As an alternative solution, shown in FIGS. 14*a*, 14*b*, link 161 is not present whereas the spring 162 is not connected with the handlebar. To control the handlebar rotation and to keep the handlebar in a straight neutral and forward position when not physically affected, a pair of springs 250 is connected to the handlebar rod 164 and to the upper frame 153. The springs allow an increased rotational motion of the handlebar. Balance of the upper frame is thus enforced by active shifting of body weight by the user.

However, as the handlebar rotation with this solution increases, the bracket 159' supporting screen and console 180 is here fixed to the front part of frame 153 and not to the handlebar shaft 164 as shown in FIGS. 8-10. This solution shown in FIG. 14*a* protects the screen and console from rotary motion 180 although it will follow the incline-decline motion of frame column 152 and frame 153.

The invention claimed is:

1. A training apparatus for physical exercise, the training apparatus having a longitudinal axis, the training apparatus comprising:

a first frame (1, 36) configured to be supported on a floor, a second frame (2, 37) connected to the first frame, the second frame including an axle (4) allowing the second frame to tilt relative to the first frame along an axis in the longitudinal direction of the training apparatus, a handlebar (12, 35, 77, 90) connected to the upper end of a steering shaft (11, 76), the steering shaft being rotationally connected to the second frame, a crank (26, 110) connected to the second frame, a first flywheel (22, 41, 56, 167, 193) rotationally connected to the lower end of said steering shaft, transfer means for transferring movement from the crank to the first flywheel, wherein said transfer means includes a belt (23) mechanically transferring rotational movement of the crank to the first flywheel, and wherein the apparatus has an electronic gearing system controlling resistance in the crank and speed of rotation of the first flywheel.

2. A training apparatus for physical exercise, the training apparatus having a longitudinal axis, the training apparatus comprising:

a first frame (1, 36) configured to be supported on a floor, a second frame (2, 37) connected to the first frame, the second frame including an axle (4) allowing the second frame to tilt relative to the first frame along an axis in the longitudinal direction of the training apparatus, a handlebar (12, 35, 77, 90) connected to the upper end of a steering shaft (11, 76), the steering shaft being rotationally connected to the second frame, a crank (26, 110) connected to the second frame, a first flywheel (22, 41, 56, 167, 193) rotationally connected to the lower end of said steering shaft, transfer means for transferring movement from the crank to the first flywheel, wherein said transfer means includes a sensor reading the motion of the crank, an electrical motor connected to the first flywheel and means for controlling the speed of the first flywheel according to the speed of the crank, and wherein the apparatus has an electronic gearing system controlling resistance in the crank and speed of rotation of the first flywheel.

3. A training apparatus for physical exercise, including a first frame (1, 36) configured to be supported on a floor, a second frame (2, 37) connected to the first frame, the second frame including an axle (4) allowing the second frame to tilt relative to the first frame along an axis in the longitudinal direction of the training apparatus, a handlebar (12, 35, 77, 90) connected to the upper end of a steering shaft (11, 76), the steering shaft being rotationally connected to the second frame, a crank (26, 110) connected to the second frame, a first flywheel (22, 41, 56, 167, 193) rotationally connected to the lower end of said steering shaft, and transfer means for transferring movement from the crank to the first flywheel, wherein said transfer means includes a second flywheel (112, 170), a belt (126) transferring rotational movement from the crank to the second flywheel, an electrical generator connected to the crank or the second flywheel, and an electrical motor connected to the first flywheel.

4. The training apparatus according to claim 1, wherein the resistance in the crank is controlled by a braking device with an electromagnet or a power generator or dynamo with adjustable resistance, which affects the freedom of rotation of the crank or flywheel.

5. The training apparatus according to claim 1, wherein the second frame is hinged to the first frame close to the floor level, with first motoring means (30, 32, 46, 55, 156, 185) controlling the incline/decline of the second frame relative to the first frame.

6. The training apparatus according to claim 5, wherein the first motoring means includes an electric motor, an electric motor with gears or a hydraulic pump and cylinder.

7. The training apparatus according to claim 5, further including a leg (3) supporting the second frame, the leg being connected to the first frame in a position close to the centre of mass of the second frame.

8. The training apparatus according to claim 1, wherein the second frame includes a spring (162) within a longitudinal part of said second frame.

9. The training apparatus according to claim 5, further including second electronically controlled motoring means (33, 45, 70) in said axle connecting the second frame to the first frame controlling the tilt of the second frame.

10. The training apparatus according to claim 1, wherein the steering shaft is connected with means for control of the second frame's tilt action.

11. The training apparatus according to claim 1, wherein the steering shaft is connected with third electronically controlled motoring means (47, 72) for controlling the turning of the steering shaft.

12. The training apparatus according to claim 1, further including means (162, 250) for centring said steering shaft around a middle position.

13. The training apparatus according to claim 1, further including sensors measuring the revolutions of the flywheels and crank for calculating the revolutions as a simulation of distance within a time unit.

14. The training apparatus according to claim 1, further including a CPU (51, 102, 181), display means (52, 100, 182) and sensors monitoring the position of the second frame relative to the first frame and the motions of the steering shaft and the crank and flywheel.

15. The training apparatus according to claim 14, wherein the CPU is adapted to display a path in a terrain to be followed by the training apparatus on said display means, control motion of the first and second frame, braking of the crank and speed of the flywheel, the controller working interactively with a computer program.

16. The training apparatus according to claim 15, wherein the CPU is adapted to detect motions of the second frame induced by a user and adjust displayed images accordingly.

17. The training apparatus according to claim 14, wherein the CPU is set up for reading and adjusting the tilt and incline/decline of the second frame and the rotational motion of the handlebar.

18. The training apparatus according to claim 4, wherein the exercise apparatus includes a power generator for creating resistance, the power generated through pedalling being supplied for charging any batteries supplied with the apparatus or with an external apparatus.

19. The training apparatus according to claim 1, further including a vertical arm (14) and ball joint-driveshaft (18) connecting the first flywheel to the steering shaft, the ball joint-driveshaft (18) being connected to a cog wheel driving said belt.

20. The training apparatus according to claim 19, wherein the ball joint-driveshaft is connected to a motor, dynamo or eddy-current braking device (24).

21. The training apparatus according to claim 1, further including gearshift levers (93, 94, 172, 172) located on handlebar, the gearing action being shown on a display or screen.

22. The training apparatus according to claim 1, wherein an interface console with the display means is supported by a bracket fixed onto the handlebar steering shaft or onto the upper frame.

23. The training apparatus according to claim 22, wherein the interface console of the apparatus is a general purpose computer or laptop, and wherein it can be removed from the apparatus and used for other purposes than when used with the apparatus.

24. The training apparatus according to claim 1, wherein the apparatus has fans (169) for generating an illusion of wind or for pure cooling.

* * * * *